US007891283B2

(12) United States Patent
Kleniatis et al.

(10) Patent No.: US 7,891,283 B2
(45) Date of Patent: Feb. 22, 2011

(54) COLLAPSIBLE BALLISTIC RESISTANT DEFENSE UNIT

(75) Inventors: John Kleniatis, Jamesville, NY (US); W. Collins White, Cicero, NY (US)

(73) Assignee: Defenshield, Inc., East Syracuse, NY (US)

( * ) Notice: Subject to any disclaimer, the term of this patent is extended or adjusted under 35 U.S.C. 154(b) by 465 days.

(21) Appl. No.: 11/744,330

(22) Filed: May 4, 2007

(65) Prior Publication Data

US 2011/0011255 A1 Jan. 20, 2011

Related U.S. Application Data

(60) Continuation-in-part of application No. 11/160,079, filed on Jun. 8, 2005, which is a division of application No. 10/243,508, filed on Sep. 14, 2002, now Pat. No. 6,907,811.

(60) Provisional application No. 60/361,768, filed on Mar. 5, 2002.

(51) Int. Cl.
*F41H 5/14* (2006.01)

(52) U.S. Cl. ..... 89/36.09

(58) Field of Classification Search ..... 89/36.07, 89/36.09, 36.15; 256/26
See application file for complete search history.

(56) References Cited

U.S. PATENT DOCUMENTS

| | | | | |
|---|---|---|---|---|
| 772,055 | A | 10/1904 | Post | |
| 1,253,964 | A | 1/1918 | Hack | |
| 1,261,518 | A | 4/1918 | Hahre | |
| 1,274,721 | A | 8/1918 | Krzan | |
| 1,281,400 | A | 10/1918 | Larnell | |
| 1,327,464 | A * | 1/1920 | Dewick et al. | 124/1 |
| 1,465,042 | A | 8/1923 | Hruska | |
| 1,875,488 | A | 6/1931 | Peters | |
| 2,370,596 | A * | 2/1945 | Wallace | 109/49.5 |
| 2,613,243 | A | 10/1952 | Frear | |
| 2,845,153 | A | 7/1958 | West | |
| 2,985,174 | A | 5/1961 | Guth | |
| 3,039,161 | A | 6/1962 | Gagnon | |
| 3,590,685 | A | 7/1971 | Lane | |
| 3,712,005 | A * | 1/1973 | Eschbach et al. | 52/210 |
| 3,942,598 | A | 3/1976 | Council | |
| 3,994,243 | A | 11/1976 | Anders | |
| 4,030,219 | A | 6/1977 | Donovan | |

(Continued)

FOREIGN PATENT DOCUMENTS

| | | |
|---|---|---|
| DE | 64 291 C | 2/1892 |

(Continued)

OTHER PUBLICATIONS

International Search Report/Written Opinion for PCT/US2008/062692 filed May 5, 2008, mailed Apr. 16, 2009.

*Primary Examiner*—Stephen M Johnson
(74) *Attorney, Agent, or Firm*—Woodcock Washburn LLP

(57) ABSTRACT

A collapsible ballistic resistant unit generally comprising an armored front panel, a ballistic resistant window slidably mounted to the front panel for selective movement between fully extended and fully retracted positions, first and second side panels hingedly mounted to opposing sides of the front panel, each movable between extended and retracted positions, and first and second casters mounted to the unit to provide rolling mobility thereto.

19 Claims, 5 Drawing Sheets

U.S. PATENT DOCUMENTS

| | | | | |
|---|---|---|---|---|
| 4,061,093 | A | 12/1977 | Carstens, Jr. et al. | |
| 4,245,546 | A | 1/1981 | Chiares | |
| 4,351,558 | A | 9/1982 | Mueller | |
| 4,416,485 | A | 11/1983 | Long | |
| 4,674,394 | A | 6/1987 | Martino | |
| 4,781,101 | A | 11/1988 | Zevuluni et al. | |
| 4,901,964 | A | 2/1990 | McConnell | |
| 4,949,490 | A | 8/1990 | Miller | |
| 4,953,820 | A | 9/1990 | Yoder | |
| 5,244,172 | A | 9/1993 | Allega | |
| 5,293,807 | A | 3/1994 | Haidu | |
| 5,368,904 | A | 11/1994 | Stephinson | |
| 5,419,479 | A | 5/1995 | Evels et al. | |
| 5,438,908 | A | 8/1995 | Madden, Jr. | |
| 5,560,149 | A | 10/1996 | Lefevre | |
| 5,703,316 | A | 12/1997 | Madden, Jr. | |
| 5,857,730 | A | 1/1999 | Korpi et al. | |
| 5,878,519 | A | 3/1999 | Huyck et al. | |
| 6,000,347 | A | 12/1999 | Madden, Jr. | |
| 6,116,326 | A | 9/2000 | Domina et al. | |
| 6,333,085 | B1 | 12/2001 | Emek | |
| 6,622,607 | B1 * | 9/2003 | Miller | 89/36.07 |
| 6,907,811 | B2 | 6/2005 | White | |
| 6,962,461 | B2 | 11/2005 | Choi et al. | |
| 7,069,680 | B1 | 7/2006 | Crawford | |
| 7,104,720 | B2 | 9/2006 | Humphries et al. | |
| 7,128,308 | B2 | 10/2006 | Marsh et al. | |
| 7,520,207 | B1 * | 4/2009 | Fuqua et al. | 89/36.07 |
| 2003/0167911 | A1 | 9/2003 | White | |
| 2004/0255769 | A1 | 12/2004 | Drackett | |
| 2005/0265780 | A1 | 12/2005 | Humphries et al. | |
| 2006/0000671 | A1 | 1/2006 | Nolley | |

FOREIGN PATENT DOCUMENTS

| | | | |
|---|---|---|---|
| DE | 2412568 | | 9/1975 |
| FR | 462 049 | A | 1/1914 |
| FR | 2607238 | | 5/1988 |
| WO | WO94/29665 | | 12/1994 |

* cited by examiner

COLLAPSIBLE BALLISTIC RESISTANT DEFENSE UNIT

CLAIM OF PRIORITY

The present application is a continuation in part and claims priority to common subject matter disclosed in Applicant's U.S. patent application Ser. No. 11/160,079, filed Jun. 8, 2005, which is a division of Applicant's U.S. patent application Ser. No. 10/243,508, filed Sep. 14, 2002, now U.S. Pat. No. 6,907,811, which claims priority to U.S. Provisional Application Ser. No. 60/361,768, filed Mar. 5, 2002.

BACKGROUND OF THE INVENTION

The present invention relates to ballistic resistant units behind which a human is intended to stand and be protected from gun fire and related ballistics, and more particularly to such units that are collapsible and easily portable.

There are many instances where official and military personnel must place themselves in harm's way. In high security facilities such as military bases, government buildings such as embassies, and other government, military and paramilitary outposts, as well as less secure facilities such as airports, marine ports, and the like have been the target of terrorist shootings, among other unexpected and dangerous events. Those individuals that stand on the front line of these locations, such as the guardsman who prevent unauthorized persons from entering a secure establishment, may become the target of a gunmen who desires to gain access to the establishment. Because such personnel are necessarily exposed to others, the risk of serious injury or death from gunfire is elevated.

Applicant's U.S. Pat. No. 6,907,811 discloses a portable ballistic resistant unit behind which a person may stand for protection from gunfire. The unit is large and comprises a sheet of ballistic resistant glazing in concert with an armored front and side walls, thereby offering three sides of ballistics protection while not inhibiting the person's line of sight. In addition, caster assemblies are used to provide mobility to the unit. The unit disclosed in the '811 patent is effective at providing the necessary protection, but does suffer a drawback in that it is somewhat cumbersome to store and is sometimes difficult to maneuver depending on the terrain due to its size.

It is therefore a principal object and advantage of the present invention to provide a ballistic resistant unit that collapses for ease of storage, shipment, and maneuverability.

Other objects and advantages of the present invention will in part be obvious and in part appear hereinafter.

SUMMARY OF THE INVENTION

In accordance with the foregoing objects and advantages, the present invention provides a collapsible ballistic resistant unit generally comprising an armored front panel, a ballistic resistant glazing window slidably mounted to the front panel for selective movement between fully extended and fully retracted positions, first and second side panels hingedly mounted to opposing sides of the front panel, each movable between extended and retracted positions, and first and second casters mounted to the unit to provide rolling mobility thereto. Although not mandatory, a transparent ballistic resistant armor could also be slidably attached to the side panels.

BRIEF DESCRIPTION OF THE DRAWINGS

The present invention will be more fully understood and appreciated by reading the following Detailed Description in conjunction with the accompanying drawings, in which.

DETAILED DESCRIPTION

Figure 2:
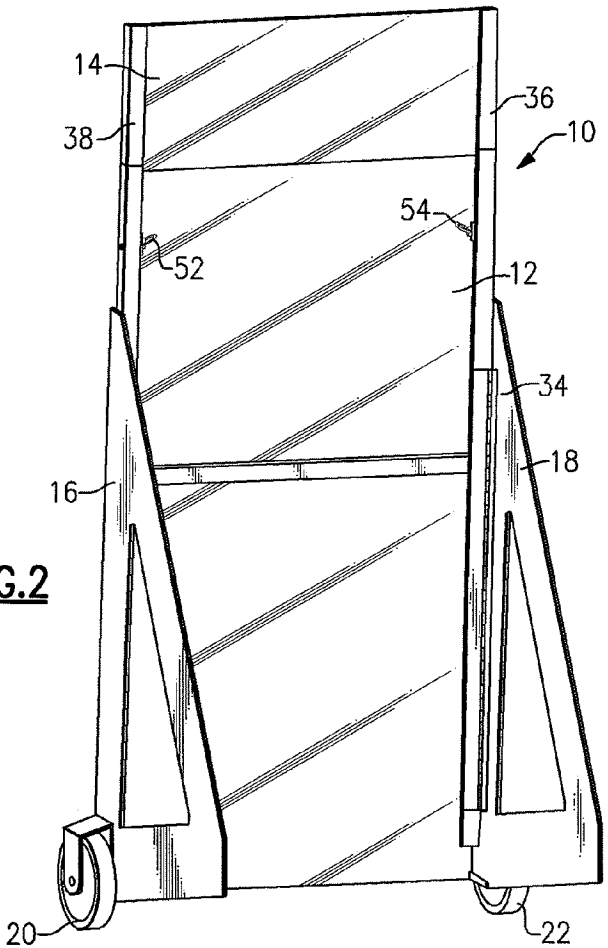
FIG. 2 is a rear perspective view of the present invention with the window in its raised position.
Figure 1:
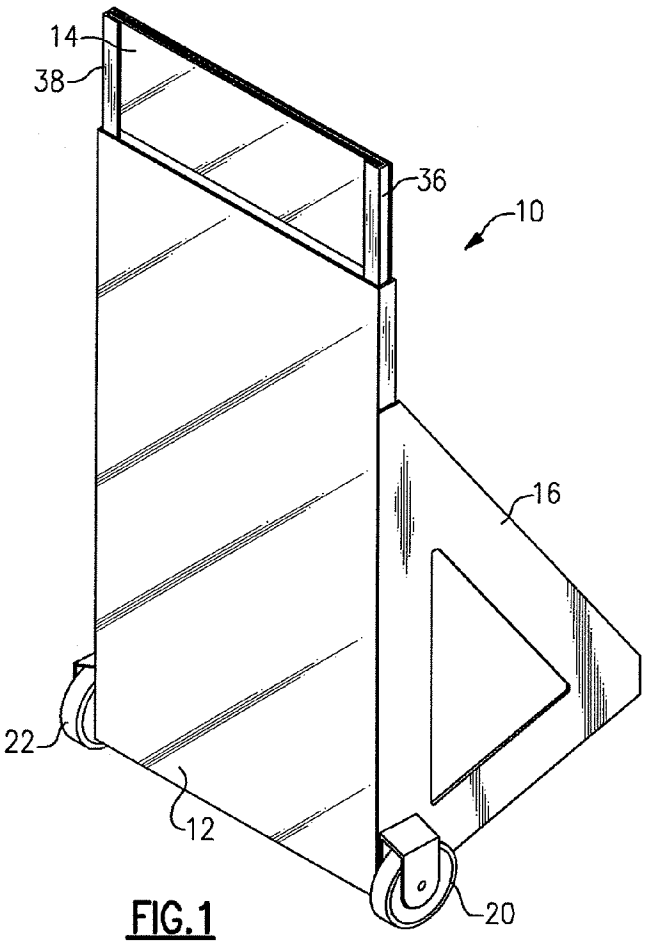
FIG. 1 is a front perspective view of the present invention with the window in its raised position.
Figure 3:
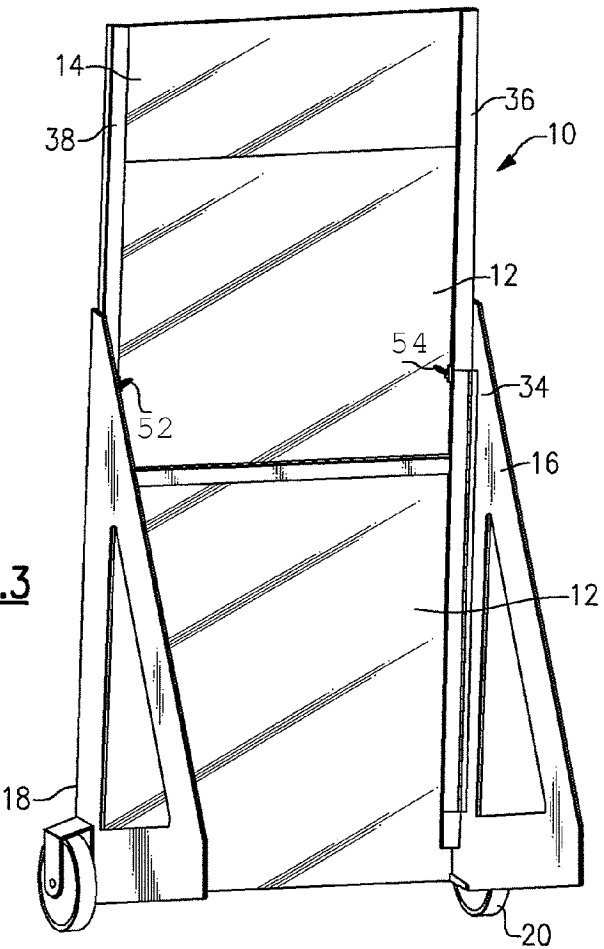
FIG. 3 is a rear perspective view of the present invention with the window in its lowered position.
Figure 6:
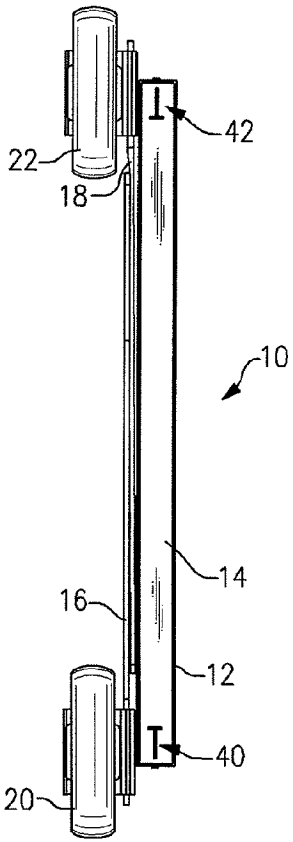
FIG. 6 is a bottom plan view of the present invention in its fully collapsed position.

Referring now to the drawings in which like reference numerals refer to like parts throughout, there is seen in FIGS. 1-3 a ballistic resistant unit, designated generally by reference numeral 10, comprising a front, armored panel 12, a ballistic resistant window 14 slidably mounted to front panel 12 for movement between extended (see FIGS. 1 and 2) and retracted/stored (see FIG. 4) positions, opposing side panels 16, 18 hingedly connected to front panel 12, and caster assemblies 20, 22, mounted to side panels 16, 18, respectively. Side panels 16, 18 may be armored if desired, but do not necessarily have to be armored. When unit 10 is in its operational mode (i.e., window 14 and panels 16, 18 in their fully extended positions), as shown in FIGS. 1-3, it provides a ballistic resistant shield behind which a person may stand to remain safe from gunfire, among other ballistics. When side panels 16, 18 are retracted, as will be more fully described hereinafter, and window 14 is also retracted, although it not does not necessarily have to be retracted, unit 10 collapses to a thin profile, as shown most clearly in FIGS. 4-6, making moving, storage, and shipment of unit 10 easier than if the unit remained un-collapsed.

In part to provide the necessary structure that permits unit 10 to collapse down to a thin profile by retracting window 14 and panels 16, 18, U-shaped channels 24, 26 are mounted to opposite side edges of front panel 12 with the open channels facing one another (i.e., the open channels are turned inwardly), and extend the majority of the distance along the edges. Each channel 24 and 26 includes a pair of vertically spaced openings 28, 30 (only one set shown—those formed through channel 24) formed towards the upper part of the channels, with the openings in the opposed channels being aligned along an essentially straight axes A-A, B-B, that extend perpendicular to the elongated axis X-X of the channels themselves (see FIG. 4).

Side panels 16, 18 are attached to the outer surface of channels 24, 26, by elongated hinges 32, 34, respectively, that permit panels 16, 18 to hinge essentially 90 degrees between fully extended (where the panels extend out at about a 90 degree angle relative to front panel 12 and in laterally spaced, parallel relation to one another), and fully retracted (i.e., where the panels extend behind front panel 12 and in overlapping relation to one another) positions.

Window 14, which may be formed of transparent armor, includes a pair of opposed interior channel members 36, 38 that are fixed to the window's glazing along the opposed side edges thereof. Interior channel members 36, 38 are adapted for selective, sliding movement within channels 24, 26, respectively, which in turn, causes window 14 to selectively move in sliding relation to channels 24, 26. More particularly, channel members 36, 38 extend the entire length of window 14 and further extend a predetermined distance beyond the bottom edge of window 14. A pair of spring loaded pin assemblies 40, 42 extend through the extended portion of channels 36, 38, respectively, and are axially aligned with one another (either along axis A-A or B-B, as will be described hereinafter). Each pin assembly 40, 42 includes the pins 44, 46 themselves, that extend through channels 36, 38, as well as a mounting bracket 48, 50, respectively, that fixes the pins in interconnected relation to channel members 36, 38 (i.e., the pins do not disconnect from channels 36, 38 even though they can be moved relative thereto.) Each pin 44, 46 also includes a ring 52, 54 on the head thereof that serves as an anchor for a cord 56 that extends between pins 52 and 54, for purposes to be explained hereinafter.

Although not shown, pins 40, 42 are spring biased and naturally extend through openings (28 or 30, for instance) formed through channels 24 and 26, unless forcibly pulled outwardly therefrom. When pins 40, 42 are engaged with one of the openings 28 or 30 (and the counterpart opening formed through channel 26), window 14 is retained in the relative position to front panel 12 as defined by the opening 28 or 30 (upper or lower). If pins of pin assemblies 40, 42 are in the upper opening (30, for instance), then window 14 will extend above the upper edge of front panel 12, creating a ballistic resistant window through which a person can stand behind while maintaining his or her line of sight. If pins of pin assemblies 40, 42 are inserted into the lower openings (28, for instance), then window 14 will be retracted and fully positioned behind front panel 12.

To move window 14 between its fully raised (extended and lowered (retracted) positions, one would pull pins of pin assemblies 40, 42 out of engagement with the openings formed through channels 24, 26, thereby freeing window 14 and channels 36, 38 to slide within channels 24, 26, respectively until pins of pin assemblies 40, 42 reengage into the other of the openings formed through channels 24, 26. While this can be done by an individual pulling out each pin of pin assemblies 40, 42 individually, and slightly moving window 14 up or down to prevent reengagement of pins of pin assemblies 40, 42 back into the opening from which it was previously disengaged, cord 56 eases this process. An individual could pull on cord 56, thereby disengaging both pins of pin assemblies 40, 42 at the same time, while holding window 14 with his or her other hand and moving the window to the desired location.

Figure 4:
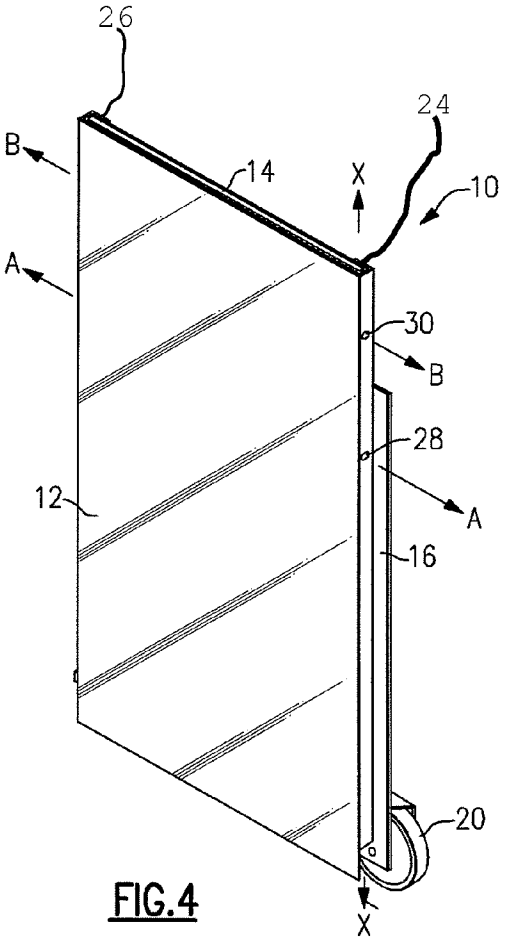
FIG. 4 is a front perspective view of the present invention in its fully collapsed position.
Figure 5:
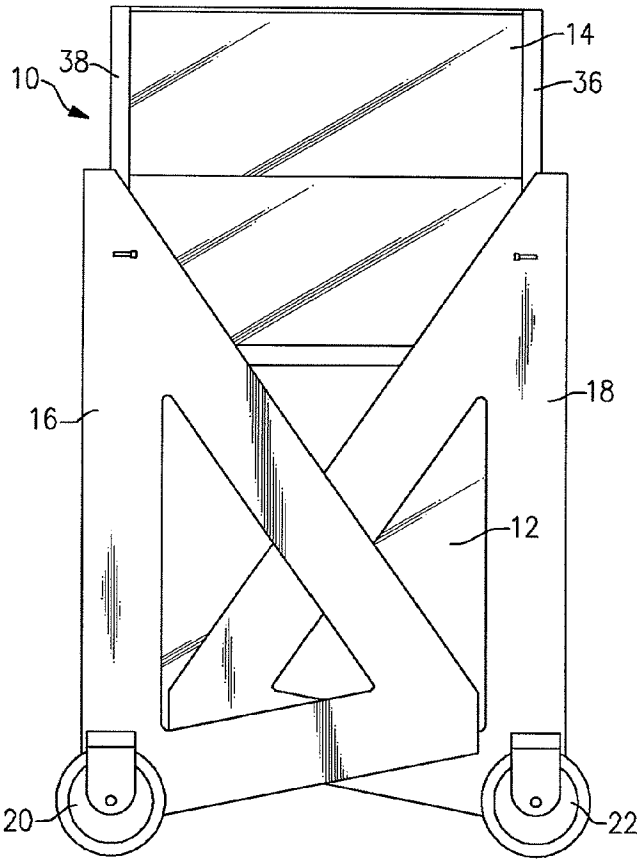
FIG. 5 is a rear perspective view of the present invention in its fully collapsed position.
Figure 7:
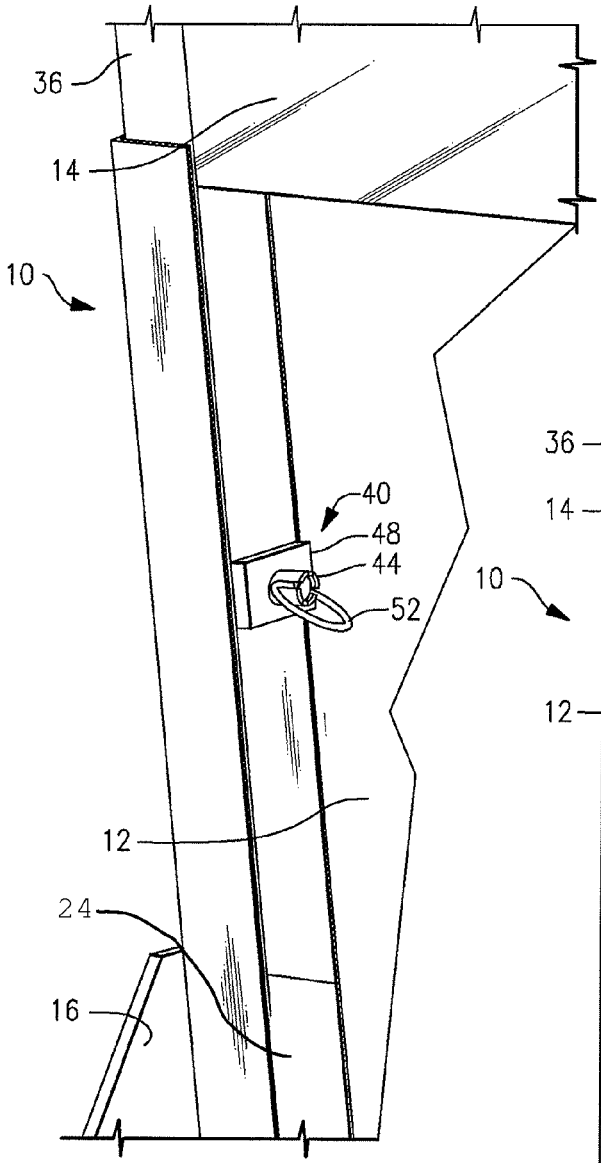
FIGS. 7 and 8 are enlarged perspective views of the window locking pin of the present invention.
Figure 8:
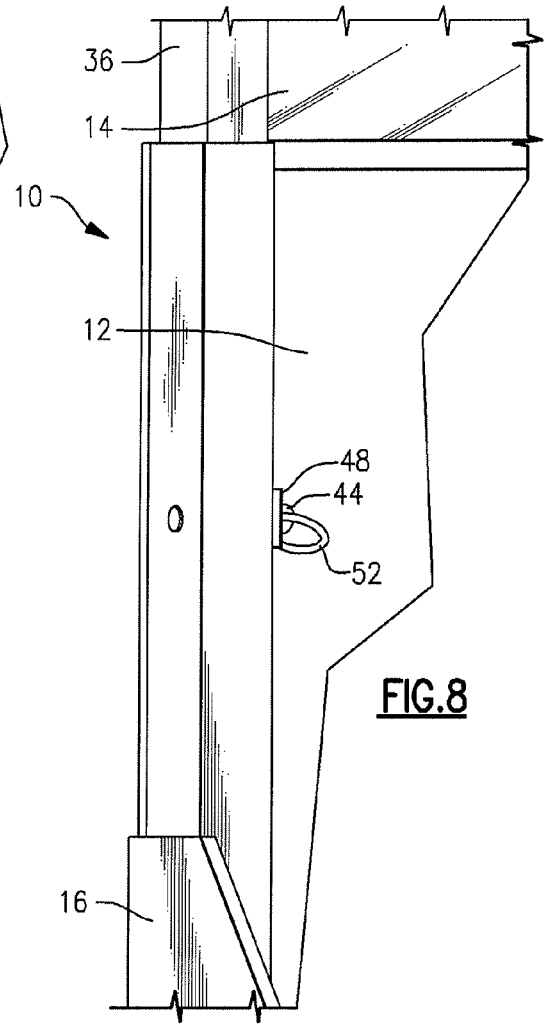
Figure 10:
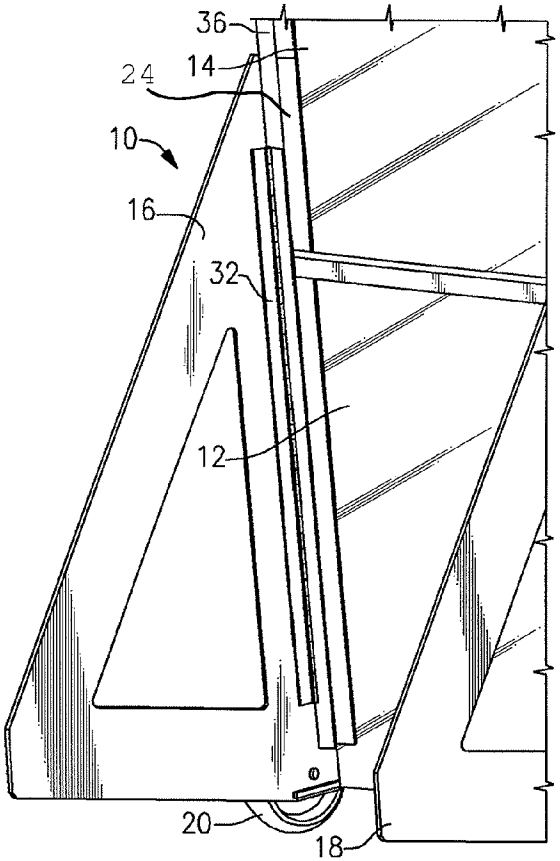
FIG. 10 is an enlarged perspective view of a side panel and hinge assembly of the present invention.
Figure 9:
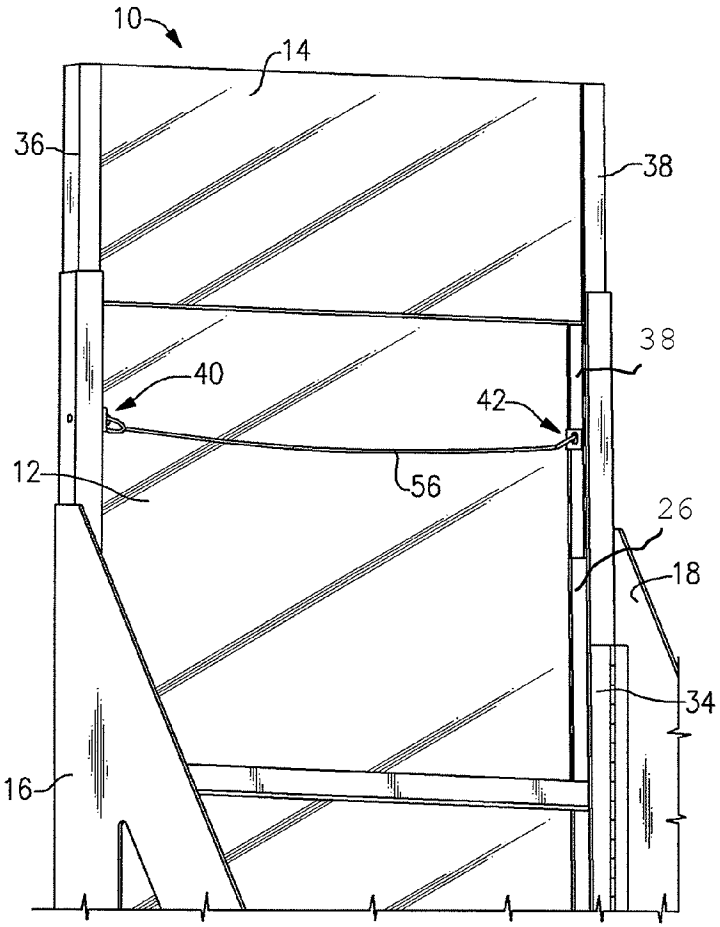
FIG. 9 is a rear perspective view of the present invention with the window in its raised position and a window control cord being illustrated.

As illustrated in FIG. 4, when side panels 16, 18 and window 14 are fully retracted, unit 10 forms a thin profile with mobility offered by casters 20, 22, thereby making storage, shipment, and movement of unit 10 convenient.

What is claimed is:

1. A ballistic resistant unit, comprising:

an armored front panel having opposing side edges, an upper edge formed between the opposing side edges, and a body formed below the upper edge and extending between the opposing side edges;

a ballistic resistant panel comprising a window, the ballistic resistant panel having an upper edge and a lower edge opposite the upper edge of the ballistic resistant panel, the ballistic resistant panel slidably mounted to said armored front panel for selective movement between an extended position wherein the upper edge of the ballistic resistant panel extends beyond the upper edge of the armored front panel and the lower edge of the ballistic resistant panel is positioned below the upper edge of the armored front panel and overlaps with the body of the armored front panel, and a retracted position wherein the upper edge of the ballistic resistant panel is proximate to the upper edge of the armored front panel and the lower edge of the ballistic resistant panel is positioned below the upper edge of the armored front panel and overlaps with the body of the armored front panel; and first and second side panels movably coupled to opposing sides of said armored front panel, each of said first and second side panels movable between extended and retracted positions.

2. The unit according to claim 1, further comprising first and second outer channel members respectively attached to said opposing side edges of said front panel.

3. The unit according to claim 2, further comprising:

a first hinge coupled to the first outer channel member and the first side panel, the first hinge proving a range of movement to the first side panel; and a second hinge coupled to the second outer channel member and the second side panel, the second hinge proving a range of movement to the second side panel.

4. The unit according to claim 2, further comprising first and second interior members coupled to said ballistic resistant panel and positioned for sliding movement within said first and second exterior channel members.

5. The unit according to claim 4, wherein the first interior member and second interior member are shaped as channels.

6. The unit according to claim 4, wherein the first interior member has an opening formed therein and the first exterior channel member has an opening formed therein, further comprising a pin removably insertable into the opening formed in the first interior member and the opening formed in the first exterior channel member.

7. The unit according to claim 4, wherein the first interior member has an opening formed therein and the first exterior channel member has an opening formed therein, wherein the second interior member has an opening formed therein and the second exterior channel member has an opening formed therein, further comprising a first pin removably insertable into the opening formed in the first interior member and the opening formed in the first exterior channel member, and further comprising a second pin removably insertable into the opening formed in the second interior member and the opening formed in the second exterior channel member.

8. The unit according to claim 4, further comprising a first pin assembly coupled to said first interior member and a second pin assembly coupled to said second interior member.

9. The unit according to claim 8, wherein said first pin assembly comprises a first pin and first mounting bracket, and said second pin assembly comprises a second pin and second mounting bracket.

10. The unit according to claim 9, further comprising a first ring coupled to said first pin and a second ring coupled to said second pin.

11. The unit according to claim 10 further comprising a cord connected to and extending between said first ring and said second ring.

12. The unit according to claim 1, further comprising a first caster and a second caster coupled to the unit.

13. A ballistic resistant unit, comprising:

an armored front panel having opposing side edges and an upper edge;

a first outer channel member and a second outer channel member respectively coupled to said opposing side edges of said front panel;

a ballistic resistant window;

a first interior member and a second interior member coupled to the ballistic resistant window, the first and second interior members respectively slidably movable within the first and second outer channel members and said ballistic resistant window selectively moveable between extended and fully retracted positions relative to the armored front panel;

first and second pin assemblies attached to said first and second interior members respectively; and first and second side panels movably coupled to opposing sides of said front panel, each of said first and second side panels being movable between extended and retracted positions.

14. The unit according to claim 13, wherein said first pin assembly comprises a first pin and a first mounting bracket, and said second pin assembly comprises a second pin and a second mounting bracket.

15. The unit according to claim 14, further comprising a first ring coupled to said first pin and a second ring coupled to said second pin.

16. The unit according to claim 15, further comprising a cord coupled to and extending between said first ring and said second ring.

17. The unit according to claim 13, further comprising a first caster and a second caster mounted to the unit to provide rolling mobility thereto.

18. The unit according to claim 13, wherein the first interior member and second interior member are shaped as channels.

19. The unit according to claim 13, wherein the first interior member has a recess formed therein and the first exterior channel member has a recess formed therein, further comprising a pin removably insertable into the recess formed in the first interior member and the recess formed in the first exterior channel member.

* * * * *